US006752690B1

(12) United States Patent
Fruitman

(10) Patent No.: US 6,752,690 B1
(45) Date of Patent: Jun. 22, 2004

(54) METHOD OF MAKING POLISHING PAD FOR PLANARIZATION OF SEMICONDUCTOR WAFERS

(76) Inventor: Clinton O. Fruitman, 3 N. Galaxy Dr., Chandler, AZ (US) 85226

( * ) Notice: Subject to any disclaimer, the term of this patent is extended or adjusted under 35 U.S.C. 154(b) by 0 days.

(21) Appl. No.: 10/167,321

(22) Filed: Jun. 12, 2002

(51) Int. Cl.[7] ..... B24B 49/00
(52) U.S. Cl. ..... 451/6; 451/41; 451/28
(58) Field of Search ..... 451/5–10, 11, 451/12, 285–290, 41, 28

(56) References Cited

U.S. PATENT DOCUMENTS 6,254,459 B1 * 7/2001 Bajaj et al. ..... 451/41
6,354,929 B1 * 3/2002 Adefris et al. ..... 451/527
2002/0173231 A1 * 11/2002 Hasegawa ..... 451/6

* cited by examiner

*Primary Examiner*—Lee D. Wilson
(74) *Attorney, Agent, or Firm*—Joseph H. Roediger; Gregory J. Nelson

(57) ABSTRACT

A method of making polishing pads used for the planarization of semiconductor wafers wherein the pad includes a polymer sleeve filled with an optical polymer to provide a window for the pad. An opaque polishing pad polymer is molded around the sleeve and window to form a large volume cake which is then cured and subdivided into a multiplicity of individual pads.

20 Claims, 2 Drawing Sheets

METHOD OF MAKING POLISHING PAD FOR PLANARIZATION OF SEMICONDUCTOR WAFERS

BACKGROUND OF THE INVENTION

This invention relates to the manufacture of polishing pads having optically transmissive windows for monitoring the chemical mechanical planarization process performed on semiconductor wafers. In particular, the present invention is directed to a novel method for the formation of optical windows in a large volume molded assembly containing a multiplicity of polishing pads and the product formed thereby.

In semiconductor manufacturing, the device layers formed by deposition of materials on semiconductor wafers requires the use of planarization processes to control the thickness of deposited films and to restore planarity to the operating surface for succeeding lithographic operations. The entire process is referred to as chemical mechanical planarization (CMP) and one of the steps of the CMP process includes the use of polishing pads to polish and render uniform the different elevational features of the exposed surface. During the conduct of the polishing process it is desirable to determine when the current stage of the process should be halted.

Typically, the decision regarding changing or halting the processing step utilizes optical detection techniques to read the thicknesses of the transparent films formed on the semiconductor wafer or to read the reflection transitions for opaque films formed thereon. In either method of monitoring the processing of semi-conductor wafers, the measurements are typically made through transparent or translucent windows formed in the polishing pads.

The windows contained in the polishing pads are typically formed by placing transparent polymer plugs into foamy type opaque polymer materials. The result is the formation of a pad having one or more relatively small area regions which are transparent and surrounded by adjacent opaque regions. The adjacent regions are relied on to carry forward with the chemical/mechanical polishing activity in combination with an applied slurry.

One approach to forming a polishing pad having a transparent window therein is disclosed in U.S. Pat. No. 5,893,796 wherein a transparent plug is preformed as a solid insert that is then molded into the pad. The reference teaches the securing of the plug in a preformed hole by adhesive bonding to the polishing pad. This technique has been found to generate problems in that the window material is different than the surrounding pad material and the cracks at the window interface allow contamination to build up between the pad and the window. Since the pad is typically formed from a foamed resin, the formation of a hole in the polishing pad to receive a preformed window results in an irregular interface. Any dimensional mismatch at a point on the interface can result in leakage during use. There is also a difficulty of dressing or grinding the pad surface in that dissimilar materials will be removed at different rates causing crowning or dishing of the window. Pad protrusions from crowning will affect the uniformity of polishing. Dishing will affect the window optics by allowing for waste materials to accumulate and occlude the light signal.

Another approach to forming windows has involved casting transparent and translucent polymers into holes cut into polishing pads. A problem with this technique is that it is difficult and costly to form the window with surfaces flush to the surfaces of the polishing pad due to resin flow and shrinkage. Alternatively, U.S. Pat. No. 5,605,760 teaches the use of a transparent pad to facilitate the determination of the endpoint in processing.

In U.S. Pat. No. 6,171,181, the formation of a one-piece molded article for use as a polishing pad is disclosed. The polishing pad is formed by solidifying a flowable polymeric material and using selective cooling rates so that one region remains transparent after hardening while the surrounding regions are cooled at a slower rate to become relatively opaque. The reference continues on by pointing out that since the transparent region and the opaque region are integrally molded from the same polymeric material, the boundary is not a distinct structural transition. The utilization of differential cooling results in a pad having regions of a crystalline phase and a region having a combination of crystalline and amorphic phases to provide different light transmissive characteristics.

The manufacturing process described in the above-noted patent reference generates individual polishing pads which are relatively thin having a thickness dimension of the order of 0.05 to 0.08 inches. The process utilizes a mold designed with an isolated temperature zone having an independent temperature control. The zone establishes an approximate shape and location of the desired transparent window. Thus, the physical characteristics and location of the window so formed are not always predictable. Furthermore, the process requires an especially designed mold to manufacture individual polishing pads.

Accordingly, the present invention is directed to a method of making a multiplicity of polishing pads in a large volume molded cake which can be skived into individual pads after the formation of the transparent window. Furthermore, the present method enables the cross-sectional area or shape of the viewing window to be defined and predictable. The bulk fabrication process utilizes a structural sleeve interposed between the opaque and transparent polymer resins to define the transparent window. The sleeve is formed from a polymer that cross-links to the polishing pad material and to the window material during curing. As a result, the junctures of the sleeve with viewing window and adjacent pad are sufficiently strong to essentially eliminate cracks or boundary separations in which accumulation of debris would otherwise occur during normal polishing operations.

SUMMARY OF THE INVENTION

The present invention is directed to a method of forming polishing pads having transparent windows and the polishing pads so formed The polishing pads are intended for use in connection with CMP processing of semiconductor wafers. The present invention is well suited for the fabrication of a large volume blank containing at least one transparent window extending therethrough thus enabling a blank capable of providing a multiplicity of polishing pads with windows to be formed in a single molding operation. The large volume blank is then subdivided to form a multiplicity of relatively thin individual polishing pads.

The present method of making a polishing pad of the type containing a light-transmissive window therein includes the steps of providing a thin-walled sleeve of a first polymeric resin. A second polymeric resin contained in the sleeve forms the window having light-transmissive capability. The sleeve is sited in a large volume mold that is filled with a third polymeric resin, typically the foaming resin used to form the blank or cake. The first and third resins are partially cured to promote cross-linking between the sleeve and surrounding blank. The second resin is added to fill the sleeve. The mold is used to define the contour of the cake that will later be skived into a multiplicity of individual polishing pads. After filling the mold with the three resin components forming the resultant pad, a curing step takes place which concurrently cures the components and forms a unitary blank suitable for subdivision into a number of individual polishing pads. The entire assembly is fully cured with the actual time and temperature parameters being determined primarily by the particular resins employed. After curing, the molded blank is removed. During the partial and full curing steps, the resins at the different interfaces between the structural sleeve and the resins bounding either side thereof become cross-linked. This cross-linking of polymers essentially eliminates any gaps or structural discontinuities between the structural sleeve and its adjacent elements.

Although a preformed and partially cured sleeve may be utilized, the preferred manner of practicing the present method utilizes a sleeve that is supported in the mold with a mandrel. After the third resin is poured into the mold and partially cured, the mandrel is removed from the mold. Then, the transparent second resin is used to fill the sleeve. The entire assembly is then fully cured while residing in the mold.

The sleeve can be formed by the immersion of a mandrel having a length at least equal to the height of the molded cake in a liquid phase of the first resin. Alternatively, the mandrel also can be wrapped with a thick film of partially cured first resin to form the sleeve. In both cases, the sleeve is filled with the optically-transmissive second resin and subjected to a partial cure. The sleeve may also be formed by the contact of the foaming resin with the mandrel to form a non-porous membrane thereabout. In this case, the sleeve and cake are formed from the same resin but possess different structural properties in the product. While the foregoing method could be used to form a single polishing pad, the manufacturing advantages offered by molding a large volume cake with a window formed by the sleeve extending therethrough and then subdividing the cake are not experienced.

The polishing pad formed in accordance with the subject invention is characterized by the presence of a non-porous resin sleeve interposed between the body of the pad and the optical window. The sleeve is cross-linked to both adjacent resin elements thereby providing structural integrity, enhanced durability and protection against leakage during use.

Further features and advantages of the invention will become more readily apparent from the following detailed description of a preferred embodiment thereof when viewed in conjunction with the accompany drawings.

DESCRIPTION OF THE PREFERRED EMBODIMENT

Figure 2:
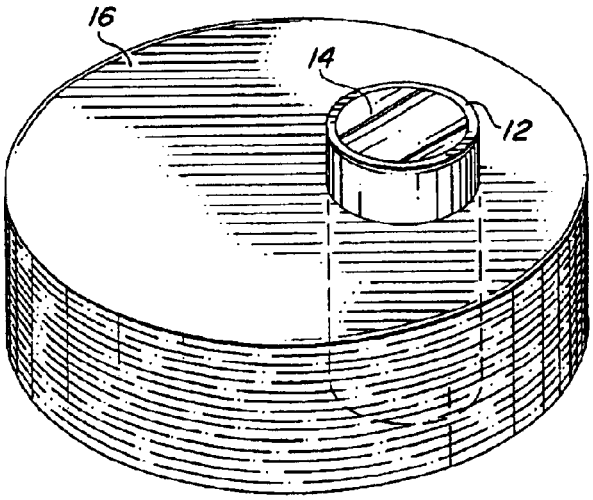
FIG. 2 is a view in perspective of a large volume cake formed in accordance with the present invention.
Figure 3:
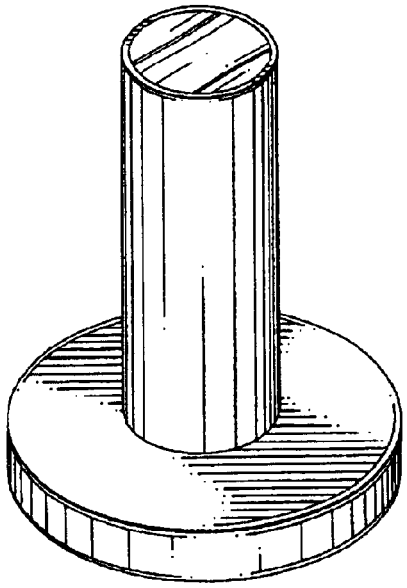
FIG. 3 is a view in perspective of a sleeve formed about a mandrel utilized in the present embodiment.
Figure 4:
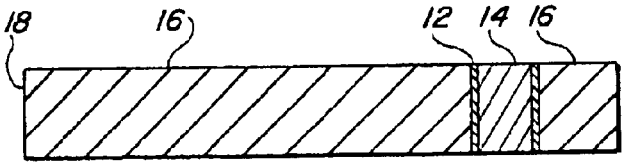
FIG. 4 is a cross-sectional view of an individual polishing pad formed in accordance with the present invention.

A molded article fabricated in accordance with the present invention takes the form of a large volume cake as shown in FIG. 2. The dashed peripheral outlines indicate the lines for skiving or dividing the cake into individual polishing pads. A typical polishing pad subdivided from the molded article of FIG. 2 is shown in FIG. 4. The polishing pad 18 of FIG. 4 includes a large region 16 which is formed of a relatively opaque foamed resin and provides the polishing surface for the individual pad. The sleeve 12 is structurally distinct from region 16 and is shown filled with optically-transmissive resin 14. The surface of the polishing pad may be ridged or scored according to the particular application for which the pad is going to be used. The constructional features of the working surfaces of polishing pads are not part of the subject invention and further discussion is not provided.

Figure 1:
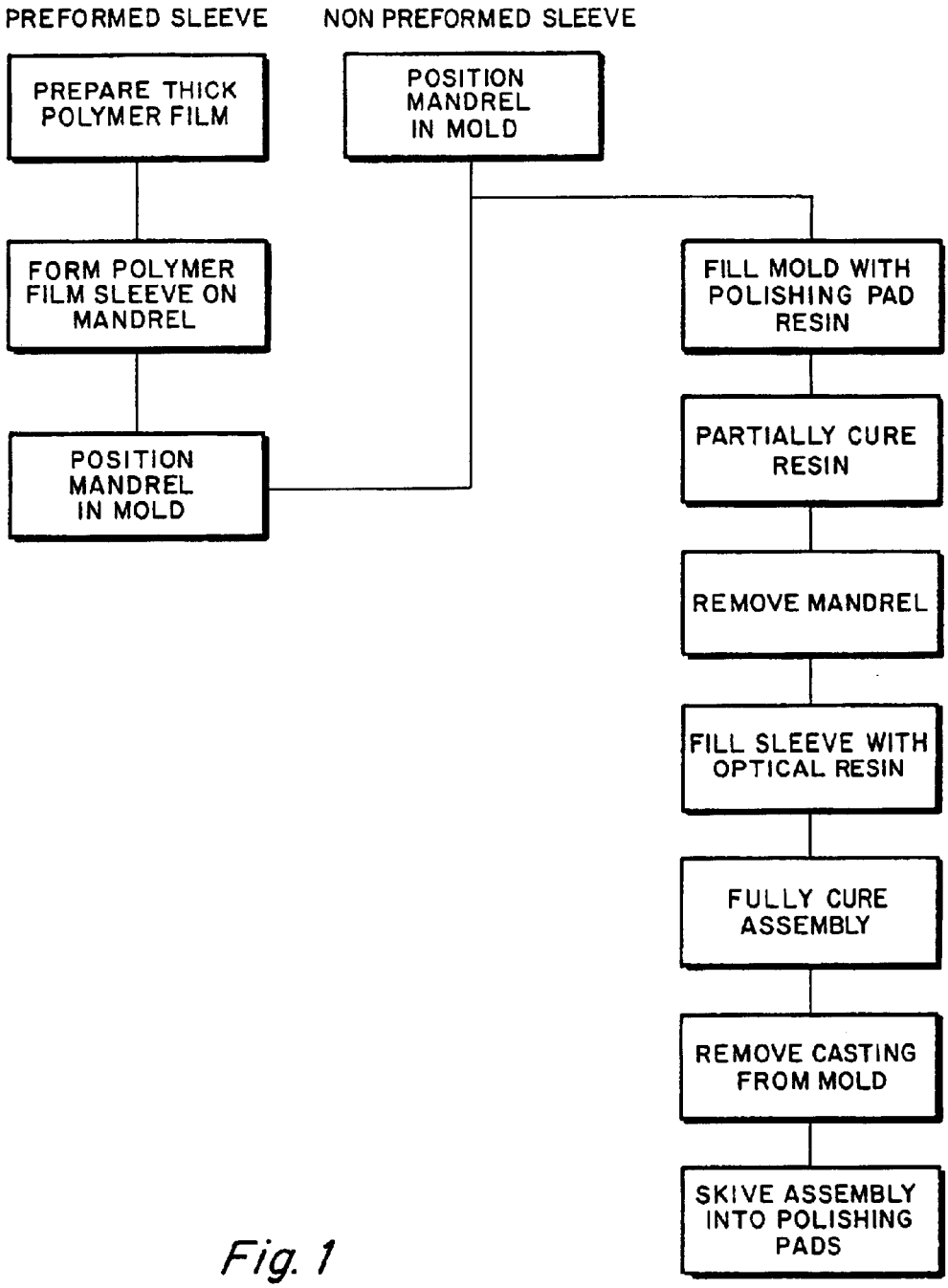
FIG. 1 is a flow chart outlining the sequence of steps used in the present embodiment of the invention.

The steps used in the preparation of the polishing pad 18 shown in FIG. 4 are outlined in the flow chart of FIG. 1. An initial step in the making of a preformed sleeve is the preparation of a polymer film to be used in the formation of the sleeve which defines the outline of the optical window. The thickness of the film is within the approximate range of 0.01 to 0.05 inches. In the practice of one embodiment of the invention, the sleeve is preferably formed from the same resin used to form the large volume regions of the polish pad. The film can be obtained by slicing a molded cake of polish pad type polymer for mechanically wrapping on a mandrel or can be formed on the mandrel. The formation on the mandrel can be performed within the mold by exposing the surface of a mandrel to the foaming resin to create a nonporous membrane on the surface of the mandrel, or externally by immersing the mandrel in an external reservoir of liquid resin to form a film thereon.

The resin cake used to form the film for the sleeve can be partially cured or fully cured as long as the slice has sufficient structural integrity to allow it to be wrapped about a mandrel and bonded closed to form a tubular cavity.

In making the sleeve by the immersion of a mandrel in a liquid phase polymer, the resin is partially cured on the mandrel to form the sleeve. The sleeve and mandrel are then positioned in a large volume mold to define the location of the optical window in the pads so produced. The cross-sectional shape of the mandrel will determine the corresponding shape of the window formed in the final product.

An efficient method of making the sleeve is to mount an unwrapped mandrel in the mold and flow the cake resin around the mandrel. The mold is typically heated and the poured cake resin is heated to about 110–120° F. During a partial cure of the cake resin, a smooth thin skin or membrane forms against the mandrel, free of the cellular bubbles that form in the cake. The membrane is a non-porous structural element that is partially cross-linked to the adjacent cake and constitutes a structural boundary for the optical resin.

After positioning the mandrel in the mold, the mold is filled with the polish pad type polymer which comprises the opaque component of the polishing pad. The mold is filled to surround the mandrel and sleeve and is at least partially cured. Next, the sleeve is filled with the optically-transmissive resin after withdrawal of the mandrel. The sleeve and surrounding resin have been at least partially cured to have structural integrity. The optical resin is added to the sleeve in a manner which minimizes entrapped gases. Since the optical resin contacts the uniform surface of the sleeve rather than the irregular surface of a foamed resin cake, bubble formation and entrapment during the formation of the window is reduced. The assembly is then submitted to a final cure while remaining in the mold. The time and temperature requirements of the final cure are a function of the particular resin materials used. When fully cured and removed from the mold, the cake appears as shown in FIG. 2 and is then subdivided into a large number of polishing pads.

During the practice of the present method, cross-linking occurs between the different phases of the polymer resins such that the optical phase, the non-porous sleeve and the surrounding foamed phase become an integral assemblage of elements. As a result, the different structural elements tend not to separate under the stress experienced during the CMP polishing process and the polishing pad formed in accordance with the present invention avoids failures due to cracking. Since the pad is sliced from the cake assembly after curing, the mechanical slicing process cuts both sides of the pad. As a result, the window is flush to the pad external surfaces. Thus, the window does not have protrusions or recesses therein which might adversely impact the work piece surface, and contamination of the optical path through the window is less likely to occur.

The resins used in the practice of the present method to form the polishing surface are typically resins such as polyether-urethanes or polyester-urethanes. The partial curing to the 'B' stage wherein the polymer molecules are partially cross-linked normally can be accomplished in fifteen minutes at elevated temperatures. The use of resins which cure at ambient temperatures requires a greater period of time to effect a partial cure. The fully cured stage normally requires baking in an oven over an extended period. It is noted that many types of polymer resins are available for use in the subject method. However, the formation of the optically-transmissive window is most important and the use of colorless optical aliphatic urethane resins is preferred due to similar mechanical and chemical properties to the polishing pad surface as well as possessing suitable light transmissivity in a broad spectrum of wavelengths.

Figure 5:
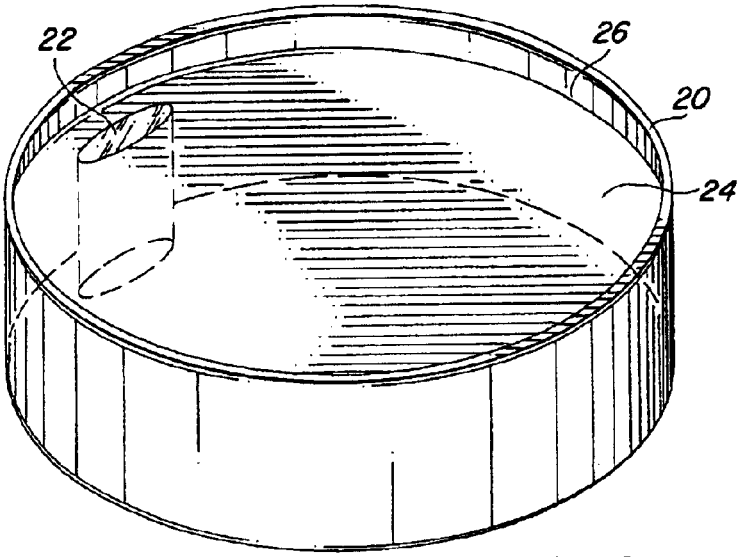
FIG. 5 is a view in perspective showing a typical mold and mandrel used in another embodiment of the present invention.

A typical mold 20 is shown in FIG. 5 with mandrel 22 inset into the bottom plate 24 of the mold. The vertical height of the mandrel exceeds fill level 26 of the mold to facilitate removal of the mandrel after curing of the poured surrounding resin. As mentioned previously, the mandrel provides the base surface for the formation of the polymer sleeve. The sleeve formation may take place within the mold from the pour of cake resin or outside the mold by immersion or wrapping of the mandrel. The mold shown contains a single mandrel and it is to be noted that multiple mandrels to form multiple windows in pads of various geometrical shapes can be used if so desired.

As an alternative to a fixed solid mandrel, a water-soluable gel can be used to form the mandrel. After placement in the mold, the cake resin is poured into the mold and surrounds the mandrel. A non-porous membrane is formed at the surface of the mandrel and a partial curing is effected. The gel is washed out to remove the mandrel from the sleeve. The optical resin is used to fill the sleeve and partially cured. The entire assemblage is then transported to an oven for full curing.

Also, a water-soluable mandrel can be used in the casting of a sleeve formed from an optical resin such as an acrylic urethane oligamer. A partial cure of the sleeve is effected by exposure to ultraviolet radiation. This resin can be the same resin used for the formation of the window in the fabricated product.

While the foregoing description has referred to different embodiments of the invention, it is recognized that modifications and variations may be made therein without departing from the scope of the invention as claimed.

What is claimed is:

1. A method of making a polishing pad blank having a light-transmissive window therein, said method comprising the steps of:

a) forming a sleeve of a first resin and positioning said sleeve in a mold;

b) filling the sleeve with a second resin having light-transmissive capability;

c) filling the mold with a third resin;

d) curing the first, second and third resins to form an unitary polishing pad blank, and e) removing the polishing pad blank from the mold.

2. The method of making a polishing pad blank in accordance with claim 1 wherein the first and second resins are the same.

3. The method of making a polishing pad blank in accordance with claim 1 wherein the first and third resins are the same.

4. The method of making a polishing pad blank in accordance with claim 1 which comprises the step of positioning a mandrel in the mold, and concurrently forming the sleeve and filling the mold with the third resin, said sleeve being formed as a non-porous membrane on the mandrel.

5. The method of making a polishing pad in accordance with claim 4 further comprising the step of partially curing the third resin and thereafter removing the mandrel from the mold.

6. The method of making a polishing pad in accordance with claim 5 wherein the step of filling the sleeve with a second resin follows the removal of the mandrel.

7. The method of making a polishing pad in accordance with claim 6 wherein the second resin is an aliphatic urethane resin.

8. The method of making a polishing pad in accordance with claim 7 further comprising the step of subdividing the blank to provide multiple polishing pads.

9. The method of making a polishing pad in accordance with claim 1 wherein the step of forming a sleeve comprises the coating of a mandrel with the first resin.

10. The method of making a polishing pad in accordance with claim 9 wherein the coating of the mandrel comprises the wrapping of a thin film of the first resin about the mandrel to form a sleeve.

11. The method of making a polishing pad in accordance with claim 9 wherein the coating of the mandrel comprises immersing the mandrel in a first resin liquid and partially curing the first resin liquid on the mandrel.

12. The method of making a polishing pad in accordance with claim 9 wherein the second resin is an aliphatic urethane resin.

13. A polishing pad blank capable of subdivision into a number of pads each of said pads having an optically transmissive window therein, said blank comprising:

a) a non-porous sleeve formed of a first resin and extending through the blank;

b) an optical window formed of a second resin and located within the sleeve; and c) a large volume cake formed of a third resin surrounding the sleeve, the resins of said sleeve and cake being cross-linked to form an unitary structure when cured.

14. The polishing pad blank in accordance with claim 13 wherein said first and third resins are the same.

15. The polishing pad blank in accordance with claim 14 wherein the second resin is an aliphatic urethane resin.

16. The polishing pad blank of claim 13 wherein the first and second resins are the same.

17. A polishing pad having an optical window therein said pad comprising:

a) a thin walled non-porous resin sleeve;

b) an optically transmissive resin located within said sleeve, and c) a resin pad surrounding said sleeve, said resin pad being cross-linked to the resin sleeve thereby providing a structural boundary between the optically transmissive resin and the foamed pad.

18. The polishing pad in accordance with claim 17 wherein the sleeve and pad are formed from the same resin.

19. The polishing pad in accordance with claim 18 wherein the optically transmissive resin is an aliphatic urethane resin.

20. The polishing pad in accordance with claim 17 wherein the sleeve is formed from the optically transmissive resin.

* * * * *